US007175465B1

(12) United States Patent
Tsai

(10) Patent No.: US 7,175,465 B1
(45) Date of Patent: Feb. 13, 2007

(54) ELECTRICAL CONNECTOR WITH A SPRING PUSH BUTTON FOR DISENGAGEMENT WITH JACK

(75) Inventor: Wen-Hsien Tsai, Taipei (TW)

(73) Assignee: Advanced Connectex Inc., Taipei (TW)

( * ) Notice: Subject to any disclaimer, the term of this patent is extended or adjusted under 35 U.S.C. 154(b) by 0 days.

(21) Appl. No.: 11/406,326

(22) Filed: Apr. 19, 2006

Related U.S. Application Data

(63) Continuation-in-part of application No. 11/211,522, filed on Aug. 26, 2005.

(51) Int. Cl.
*H01R 13/627* (2006.01)

(52) U.S. Cl. ..... 439/352

(58) Field of Classification Search ..... 439/352, 439/353, 357
See application file for complete search history.

(56) References Cited

U.S. PATENT DOCUMENTS

| | | | | |
|---|---|---|---|---|
| 4,838,808 | A * | 6/1989 | Fujiura | 439/357 |
| 5,609,499 | A * | 3/1997 | Tan et al. | 439/445 |
| 5,749,746 | A * | 5/1998 | Tan et al. | 439/357 |
| 5,797,771 | A * | 8/1998 | Garside | 439/610 |
| 6,257,914 | B1 * | 7/2001 | Comerci et al. | 439/357 |
| 6,290,530 | B1 * | 9/2001 | Chang | 439/378 |
| 6,364,687 | B1 * | 4/2002 | Chen | 439/358 |
| 6,431,901 | B1 * | 8/2002 | Yeh | 439/357 |
| 6,454,577 | B1 * | 9/2002 | Yi | 439/108 |
| 6,595,801 | B1 * | 7/2003 | Leonard et al. | 439/607 |
| 6,607,397 | B1 * | 8/2003 | Zhang et al. | 439/357 |
| 6,948,965 | B2 * | 9/2005 | Kumamoto et al. | 439/358 |
| 6,997,733 | B2 | 2/2006 | Peng | 439/353 |
| 2003/0228788 | A1 * | 12/2003 | Igarashi et al. | 439/358 |

* cited by examiner

*Primary Examiner*—Tulsidas C. Patel
*Assistant Examiner*—Vladimir Imas
(74) *Attorney, Agent, or Firm*—Troxell Law Office, PLLC

(57) ABSTRACT

An electrical connector including a jack and a plug is disclosed. The plug includes a spring biased push button slidably anchored in an opening on a top shell and including an indentation at either side, and a front trigger adjacent the indentation; two U-shaped positioning devices each comprising a front first protrusion at one end and an intermediate second protrusion; and a shield case comprising a grounding plate. The push button is pushed forward to engage with a front end of the opening in an inoperative state. The push button is adapted to push rearward to cause the trigger to push and press down the second protrusions until the first protrusions clear internal openings of the jack such that a subsequent pulling will disengage the plug with the jack.

3 Claims, 10 Drawing Sheets

ELECTRICAL CONNECTOR WITH A SPRING PUSH BUTTON FOR DISENGAGEMENT WITH JACK

This is a continuation-in-part of U.S. patent application Ser. No. 11/211,522, filed on Aug. 26, 2005 in the name of Wen-Hsien Tsai and entitled "LATCHING STRUCTURE OF A CONNECTER" is now pending.

BACKGROUND OF THE INVENTION

1. Field of the Invention

The present invention relates to electrical connectors, and more particularly to such an electrical connector having a spring biased push button adapted to push in a direction away from a fastened jack for disengagement therewith.

2. Description of Related Art

With the progress of technology, more advanced electronic products are available in a faster pace. Also, the development of transmission interfaces is significant in recent years. For example, universal serial bus (USB), digital video interface (DVI), high definition multimedia interface (HDMI), etc. are some well known ones. Electrical connectors compatible with these interfaces are also developed constantly. In addition to the transmission speed, the foregoing various connectors emphasizes factors such as cable length, lightweight, etc. in order to increase the connection reliability. Otherwise, a normal plugging or unplugging of the electrical connector may break cable or cause a disengagement of the connector components. For eliminating such problem, an electrical connector with latching hooks on its plug portion has been disclosed. For example, U.S. Pat. No. 6,997,733 discloses an electrical connector assembly as shown in FIG. 9. The connector assembly comprises a shroud and a connector including an insulating body A, a plurality of parallel conductors, two positioning devices D each having an intermediate protrusion D1 and a hook end D2, a metal front housing E having two side openings E1 on its front sheath with the hooks D2 inserted thereinto for fastening, a metal rear housing coupled to the front housing by soldering, a base, upper and lower holding plates B, and a plastic case C having a top latch C1 for releasably fastening the shroud. For disengagement with the shroud, a user may press the latch C1 to urge against the protrusions D1 which in turn cause the hooks D2 to disengage with corresponding openings of the shroud by retracting into the aligned openings E1.

The patent has the advantage of being reliable in its fastened state. However, the above disengagement may require the exertion of a great force. This in turn may wear the hooks and other associated components in a short period of time of use. Moreover, force exerted on the latch is required to be equal. Otherwise, it is possible of causing only one hook dislodgement. Thus, a need for improvement still exists.

SUMMARY OF THE INVENTION

An object of the present invention is to provide an electrical connector including a jack having two internal opening, and a plug comprising a top shell comprising a third opening; a spring biased push button slidably anchored in the third opening and comprising an indentation at either side, and a front trigger adjacent the indentation; two positioning devices each comprising a front first protrusion at one end, a rear U-shaped positioning member, and an intermediate second protrusion; a shield case comprising a front sheath having two side first openings, an intermediate peripheral flange, two side first slits in a rear; an insulative body including a forward extension including two side flats, a front projected plate, and a plurality of lengthwise T-shaped first apertures arranged in upper and lower rows wherein the extension is fitted in the sheath; a rear U-shaped frame element including two inner recessed portions on both sides, and two rear sidewalls each including a lengthwise U-shaped second slit extended toward the flat wherein each positioning device is inserted through the second slit with the first protrusion passed the second slit and the flat to project from the first opening, and upper and lower grooves; a plurality of conductors tightly inserted into the first apertures; a grounding plate including two hooks extended forward from both sides; upper and lower transverse, flexible holding members each including two end latches and a plurality of second apertures wherein the upper and lower holding members are mounted on a portion between the second protrusions and rear ends of the positioning devices with the latches anchored in the grooves; and a rectangular base including a forward transverse cut with the grounding plate mounted therein, and a plurality of forward pegs fastened in the first apertures with the hooks securely received in the recessed portions and being in contact with the sheath; a metal upper case comprising two lengthwise top second openings; a metal lower case matingly secured to the upper case with the second protrusions projected from the second openings into the indentations; a bottom shell; and a strain relief with an external portion of the conductors passed through and secured to the top and the bottom shells and; wherein the bottom shell is matingly secured to the top shell for forming the plug; the push button is pushed forward to engage with a front end of the third opening in an inoperative state; and the push button is adapted to push rearward to cause the trigger to push and press down the second protrusions until the first protrusions clear the internal openings of the jack by retracting into the first openings such that a subsequent pulling of the plug will disengage the plug with the jack.

In an aspect of the present invention the trigger comprises two inclined surfaces facing the indentations.

In another aspect of the present invention the positioning member comprises teeth.

The above and other objects, features and advantages of the present invention will become apparent from the following detailed description taken with the accompanying drawings.

DETAILED DESCRIPTION OF THE PREFERRED EMBODIMENTS

Figure 1:
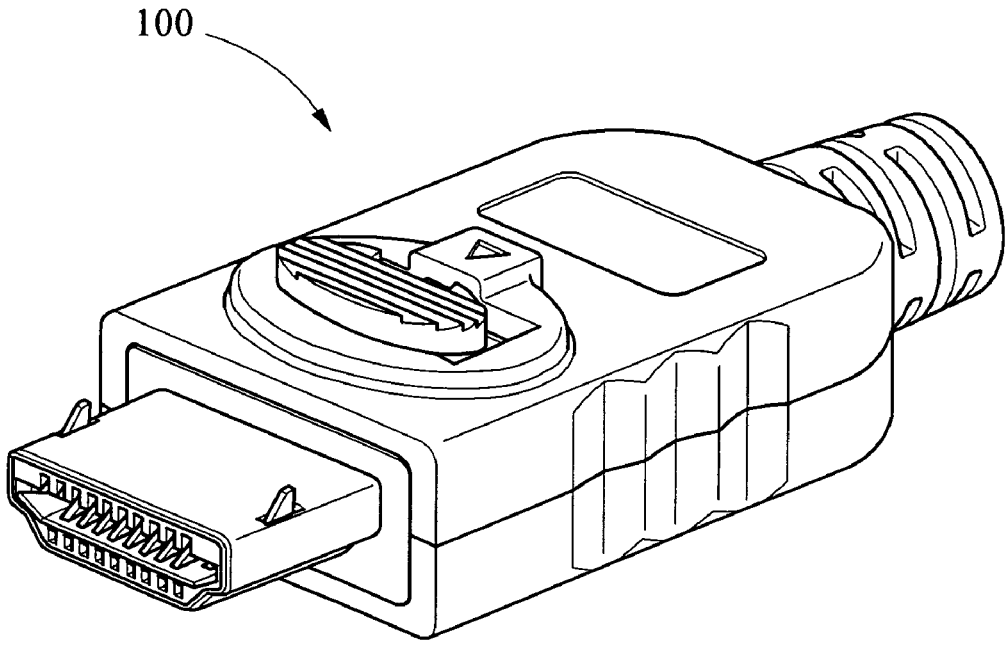
FIG. 1 is a perspective view of a preferred embodiment of a plug of an electrical connector according to the present invention.
Figure 2:
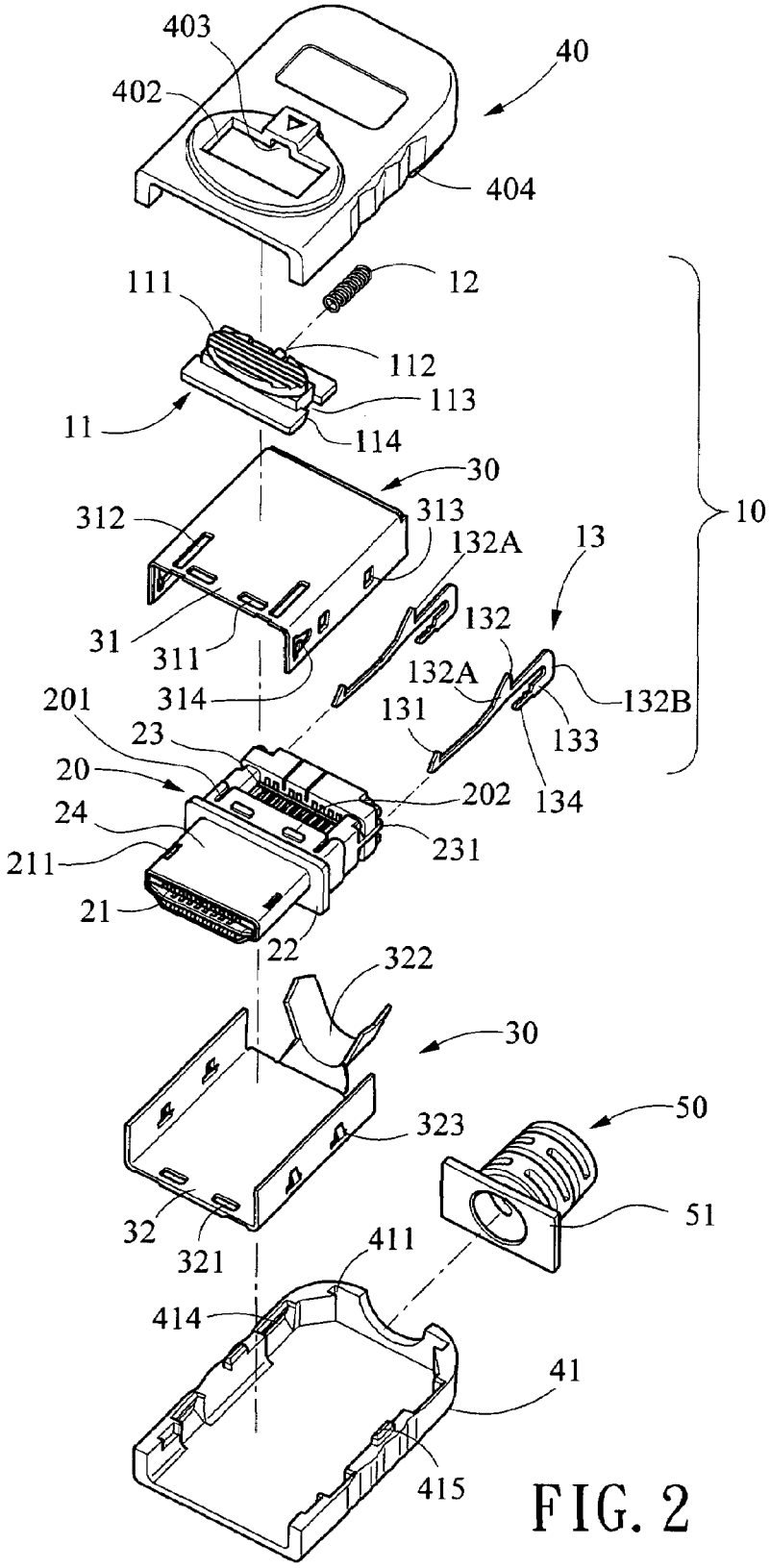
FIG. 2 is an exploded perspective view of the plug of an electrical connector according to the present invention.
Figure 3:
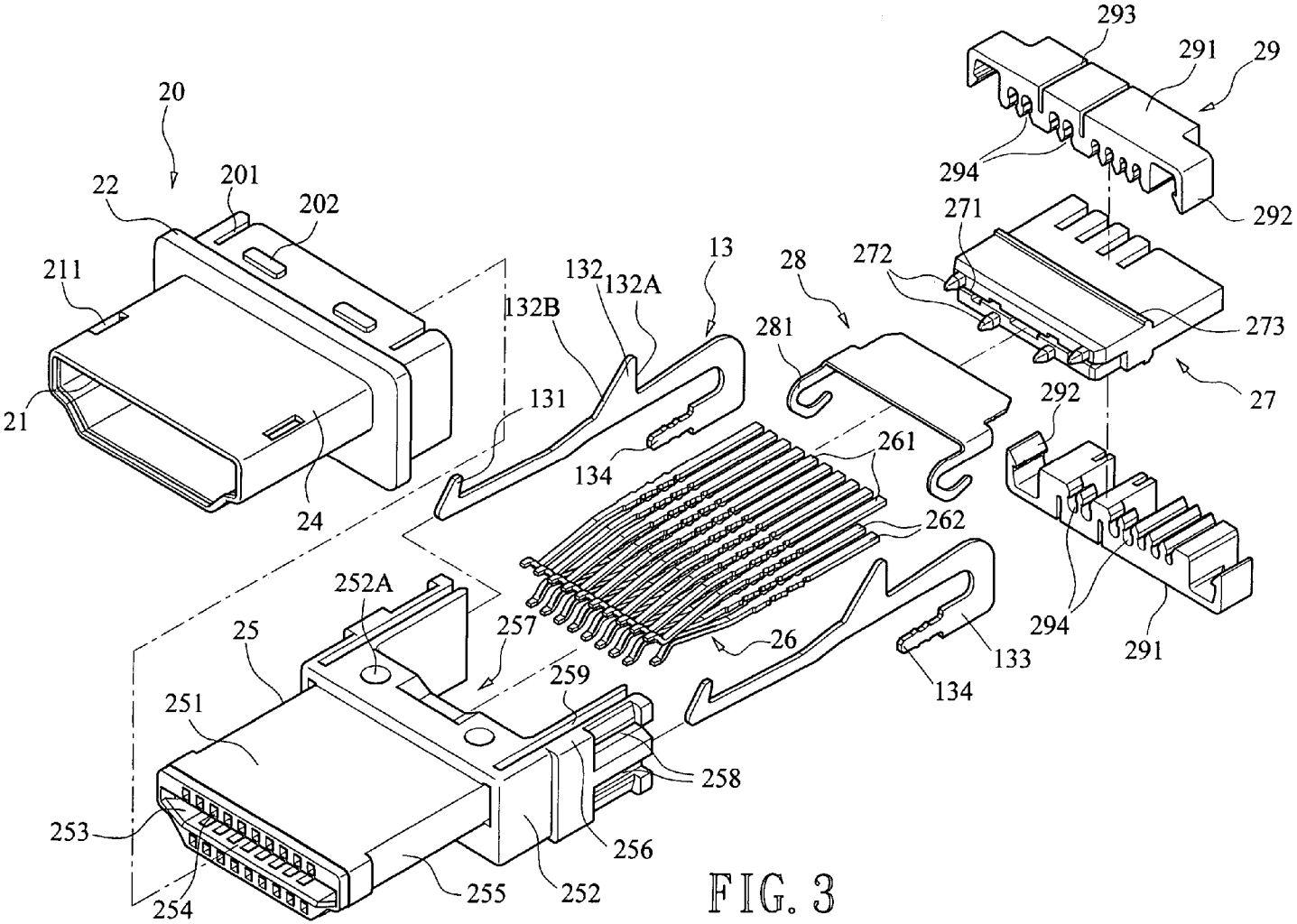
FIG. 3 is an exploded perspective view of the shield case and the positioning devices.
Figure 3A:
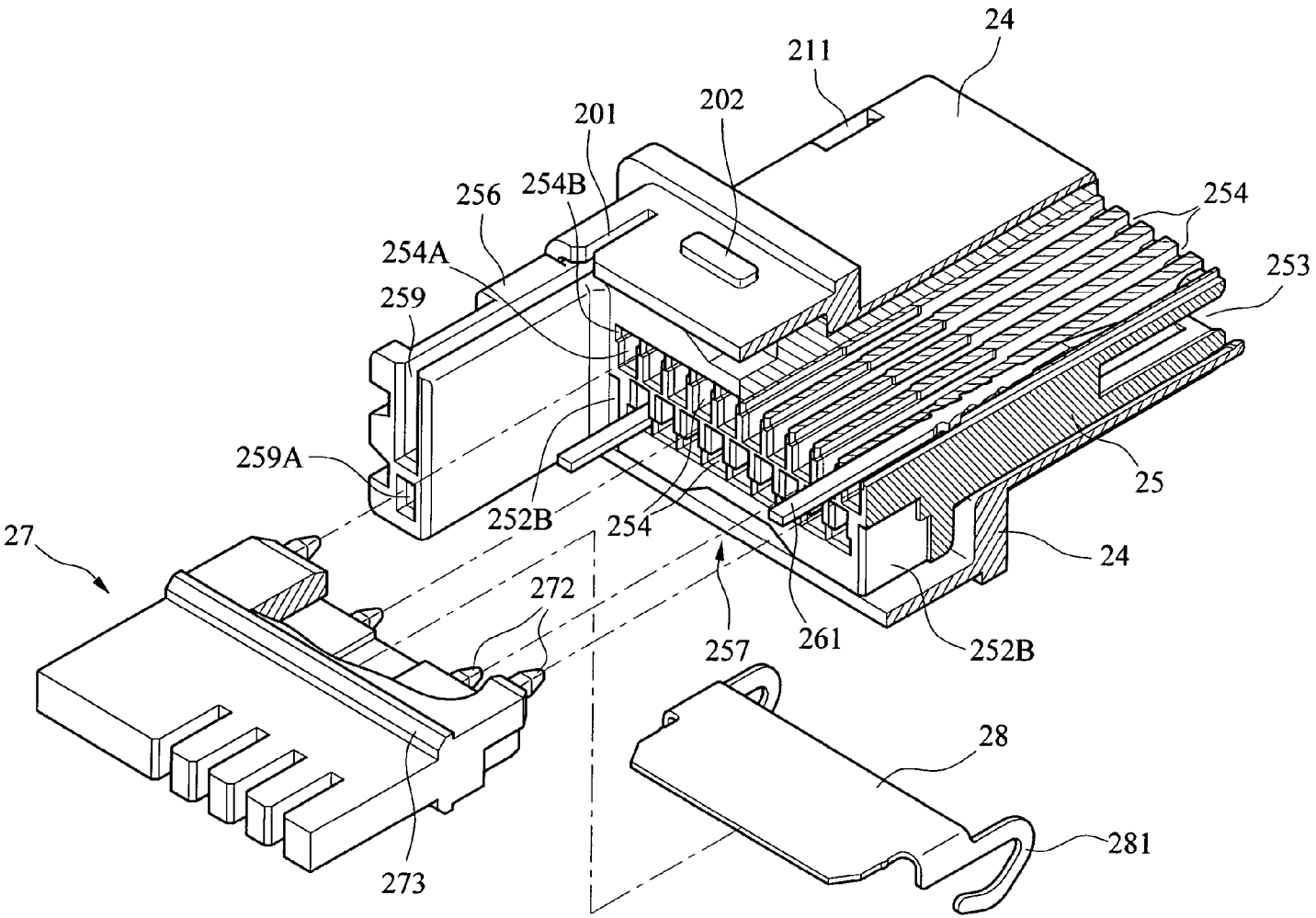
FIG. 3A is a partial broken-away perspective view of the half-assembled shield case.
Figure 3B:
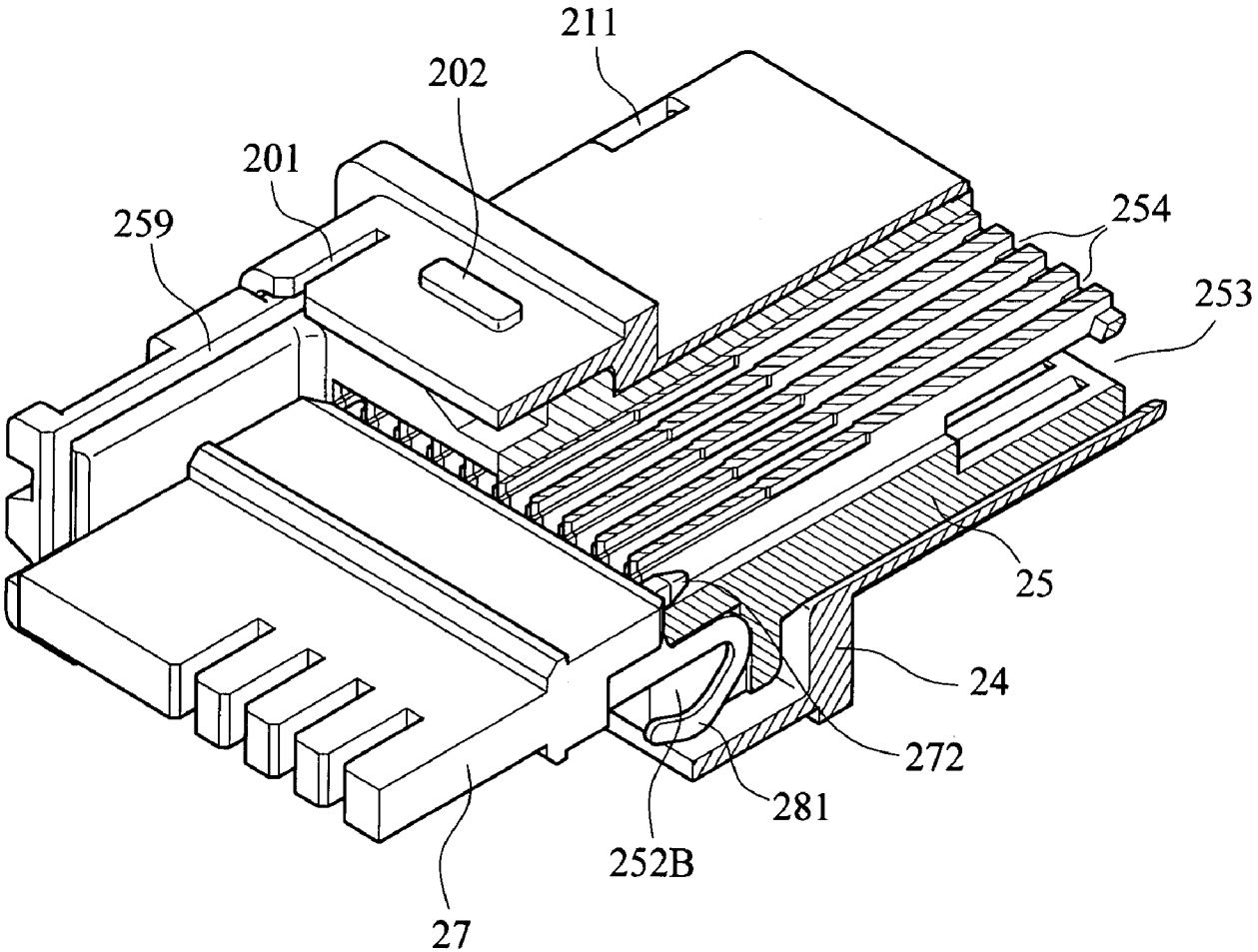
FIG. 3B is a partial broken-away perspective view of the fully assembled shield case.
Figure 4:
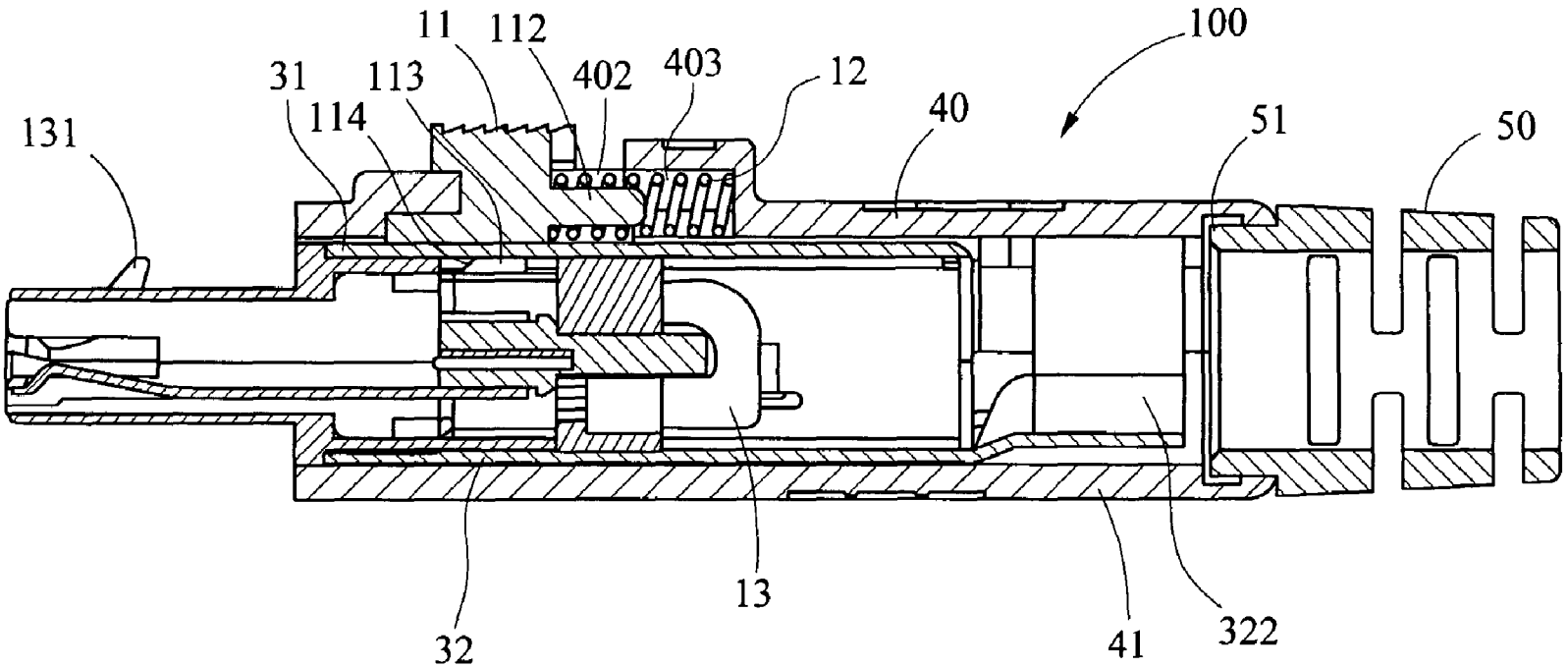
FIG. 4 is a lengthwise sectional view of the electrical connector.
Figure 5:
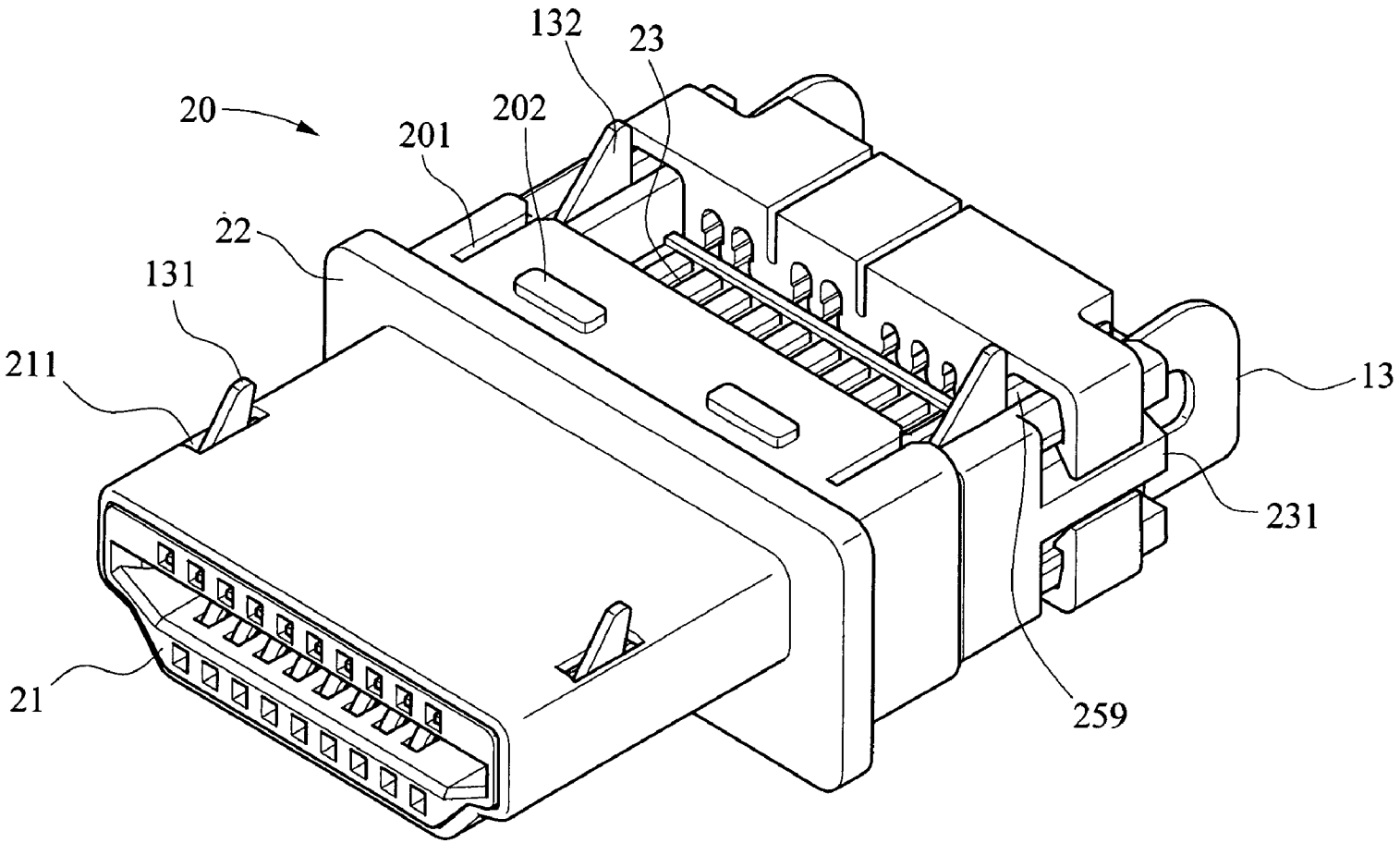
FIG. 5 is a perspective view of the assembled shield case and positioning devices.
Figure 6:
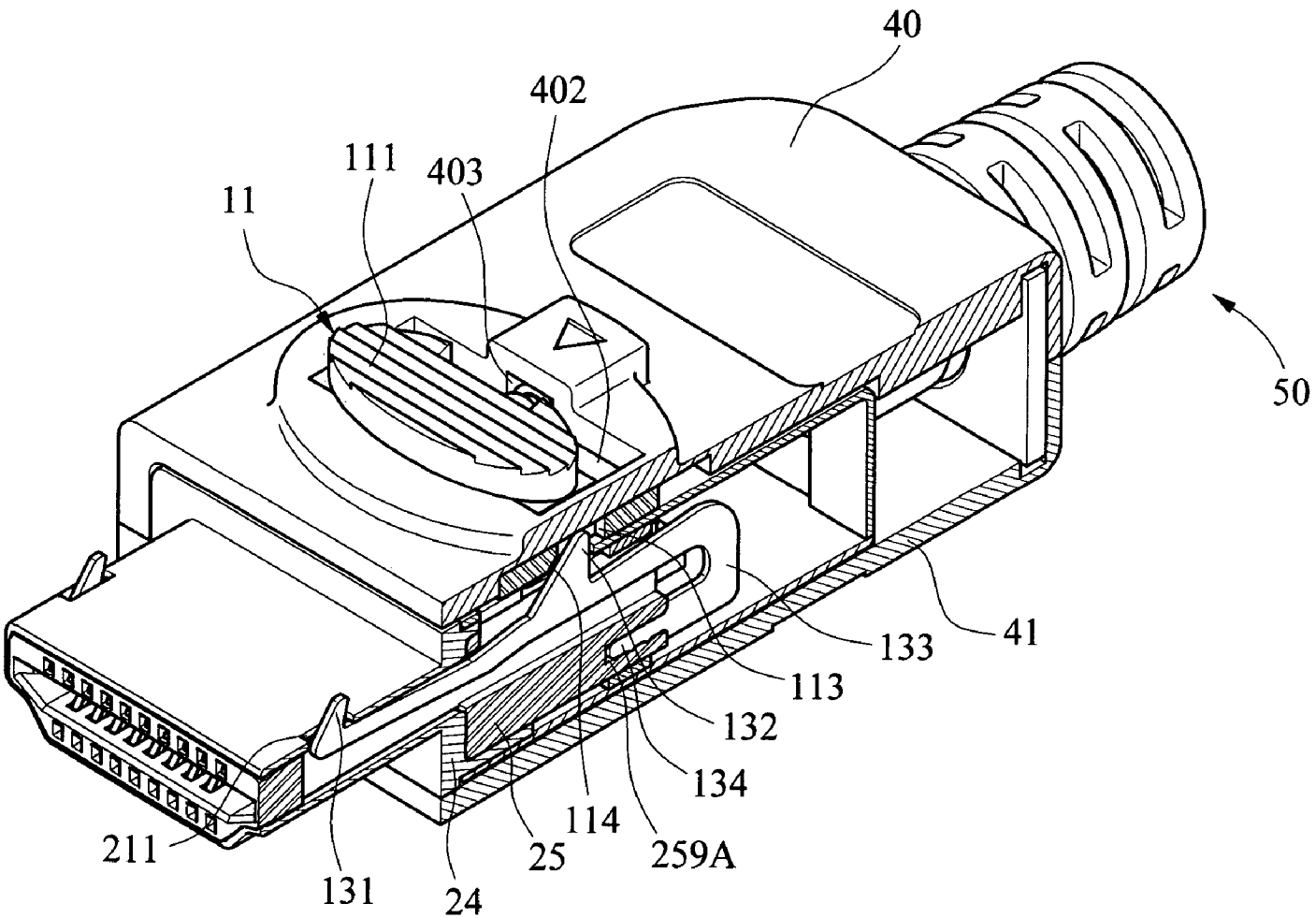
FIG. 6 is a side broken-away perspective view of the electrical connector.

Referring to FIGS. 1 to 6, an electrical connector 100 of the invention comprises a jack (not shown) and a plug including a sliding unit 10, a shield case 20, a metal casing 30, a top shell 40, a bottom shell 41, and a strain relief 50. Each component is discussed in detailed below. The sliding unit 10 is comprised of a rectangular slide member 11 including a top push button 111, a rear bar-shaped projection 112, and an indentation 113 at either side, a front trigger 114 having two inclined surfaces each adjacent a forward end of the indentation 113, a compression spring 12, and two elongated positioning devices 13 each including a front first protrusion 131 at one end, a rear U-shaped positioning member 133 having teeth 134, and an intermediate second protrusion 132 having a rear shoulder 132A and a forward slope 132B.

The shield case 20 comprises a front projected sheath 24 having a lengthwise channel 21 and two side first openings 211, an intermediate peripheral flange 22, a rear peripheral frame including two side first slits 201 and two tabs 202 on top and bottom surfaces of the frame respectively and between the first slits 201; an insulative body 25 including a forward rectangular extension 251 including two side flats 255, a front projected plate 253, and a plurality of lengthwise T-shaped first apertures 254 arranged in upper and lower rows and each including an upper narrow section 254A and a lower wide section 254B; a rear U-shaped frame element 252 including two inner recessed portions 252B on both sides, two rear sidewalls 256 each including a lengthwise U-shaped second slit 259 extended toward the flat 255 and having a lower, short hole 259A, upper and lower grooves 258, and two protuberances 252A on top and bottom surfaces respectively; and a rear receptacle 257 defined by the frame element 252; a plurality of conductors 26 arranged in top and bottom groups 261 and 262; a grounding plate 28 including two hooks 281 extended forward from both sides; upper and lower holding members 29 each including an elongated body 291, two end latches 292, two intermediate troughs 293 on an outer face, and a plurality of second apertures 294; and a rectangular base 27 including a forward transverse cut 271, a plurality of forward pegs 272, and a transverse ridge 273 on either top face or bottom face.

The metal casing 30 comprises an upper case 31 and a lower case 32 both have a U-section. The upper case 31 comprises two second openings 311 on its top front edge, two third openings 312 on its top proximate both sides, two fourth openings 313 on either side, and a resilient member 314 on either side proximate a forward edge. The lower case 32 comprises two fifth openings 321 on its bottom front edge, two latch members 323 on either side, and a curved member 322 extended from rear.

Each of the top and bottom shells 40 and 41 is of U-section. The top shell 40 comprises a top rectangular sixth opening 402 and a hollow raised member 403 at a rear end of the sixth opening 402. Other components of the top shell 40 are the same as that of the bottom shell 41. The bottom shell 41 comprises a wave section 404 on either side, a rear recess 411, an inner cavity 414 at either side, and a stud 415 at a top edge of either side. But the cavities 414 and the recesses 411 of the bottom shell 41 are located in corresponding relationship with the recesses 411 and the cavities 414 of the top shell 40 such that they can be matingly fastened together as detailed later. A portion of external conductors 26 are enclosed in the tubelike strain relief 50 which comprises a rectangular forward plate 51.

An assembly of the invention will be described in detailed below. First, insert the conductors 26 into the first apertures 254 for positioning. Insert the insulative body 25 into the sheath 24 until the U-shaped frame element 252 is stopped by an inner shoulder of the insulative body 25. Insert each positioning device 13 through the second slit 259 until the teeth 134 are inserted into the hole 259A and stopped therein. Also, the first protrusion 131 passes the second slit 259 and the flat 255 to project from the first opening 211. Next, mount both the upper and lower holding members 29 on a portion between the second protrusions 132 and rear ends of the positioning devices 13 with the latches 292 put in the grooves 258 and the conductors 26 lockingly received in the second apertures 294. Insert the grounding plate 28 into the cut 271 for positioning. Insert the pegs 272 into the first apertures 254 for positioning with the hooks 281 securely received in the recessed portions 252B and being in contact with the sheath 24. Next, enclose the above assembled components by the upper and lower cases 31 and 32 with the tabs 202 projected from the second openings 311 and the fifth openings 321 respectively, the second protrusions 132 projected from the third openings 312 into the indentations 113, the latch members 323 anchored in the fourth openings 313, and the resilient members 314 urged against both sides of the lower case 32. Put the above assembled components in the bottom shell 41. Insert an external portion of the conductors 26 through the strain relief 50. Place the plate 51 in the recess 411 of the bottom shell 41. Put the spring 12 on the projection 112. Mount the projection 112 in the hollow portion of the raised member 403 with the slide member 11 anchored in the sixth opening 402 and the second protrusions 132 in the indentations 113 respectively. Finally, insert the cavities 414 and the recesses 411 of the top shell 40 into the recesses 411 and the cavities 414 of the bottom shell 41 for fastening together. This completes the assembly.

Figure 7:
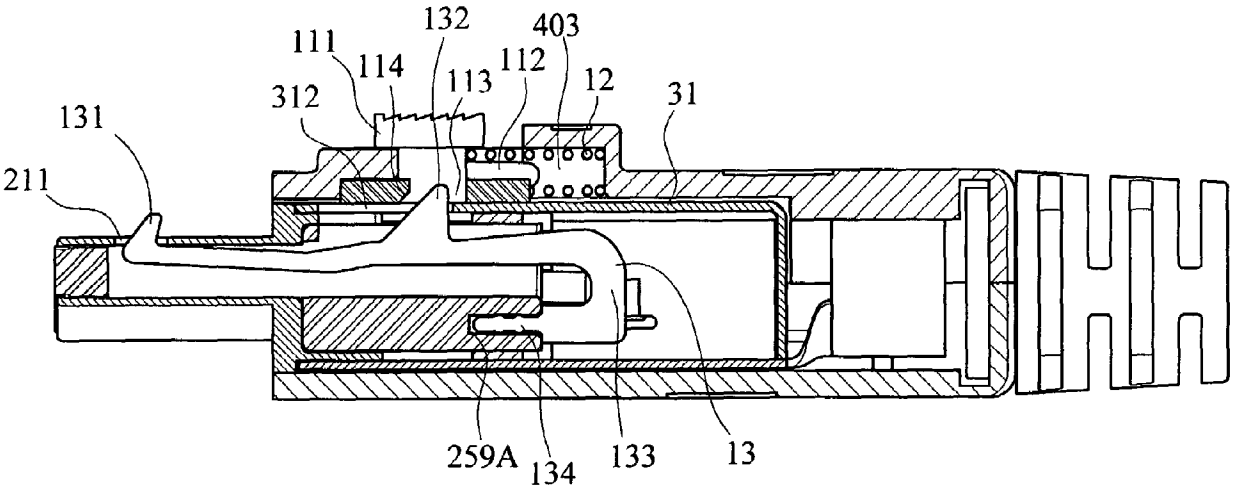
FIG. 7 is a lengthwise sectional view of the electrical connector where the slide member is not operative.
Figure 8:
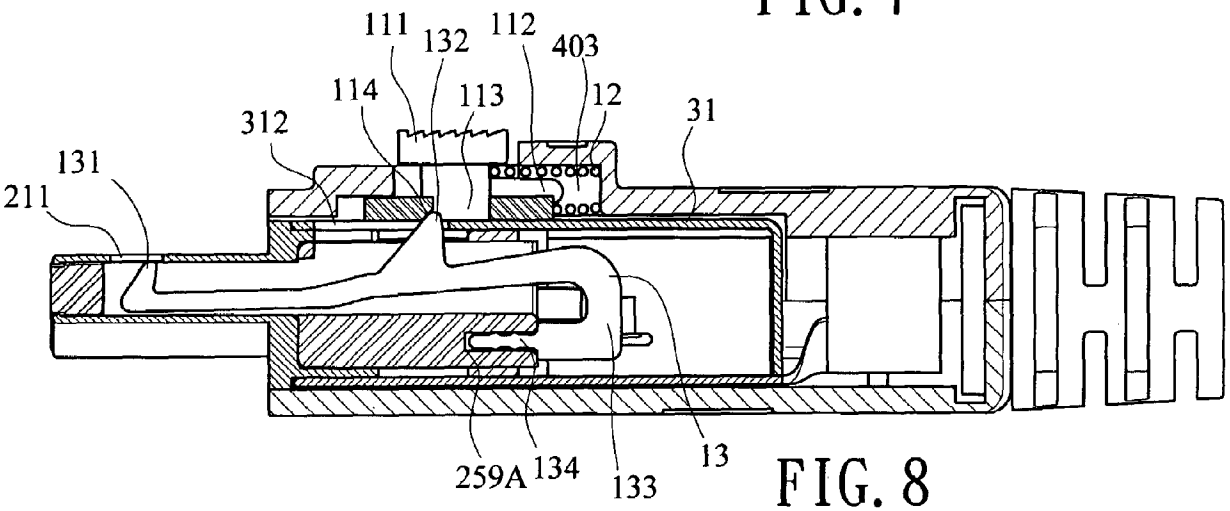
FIG. 8 is a view similar to FIG. 7 where the slide member has been pushed in a direction away from a jack so as to disengage therewith.
Figure 9:
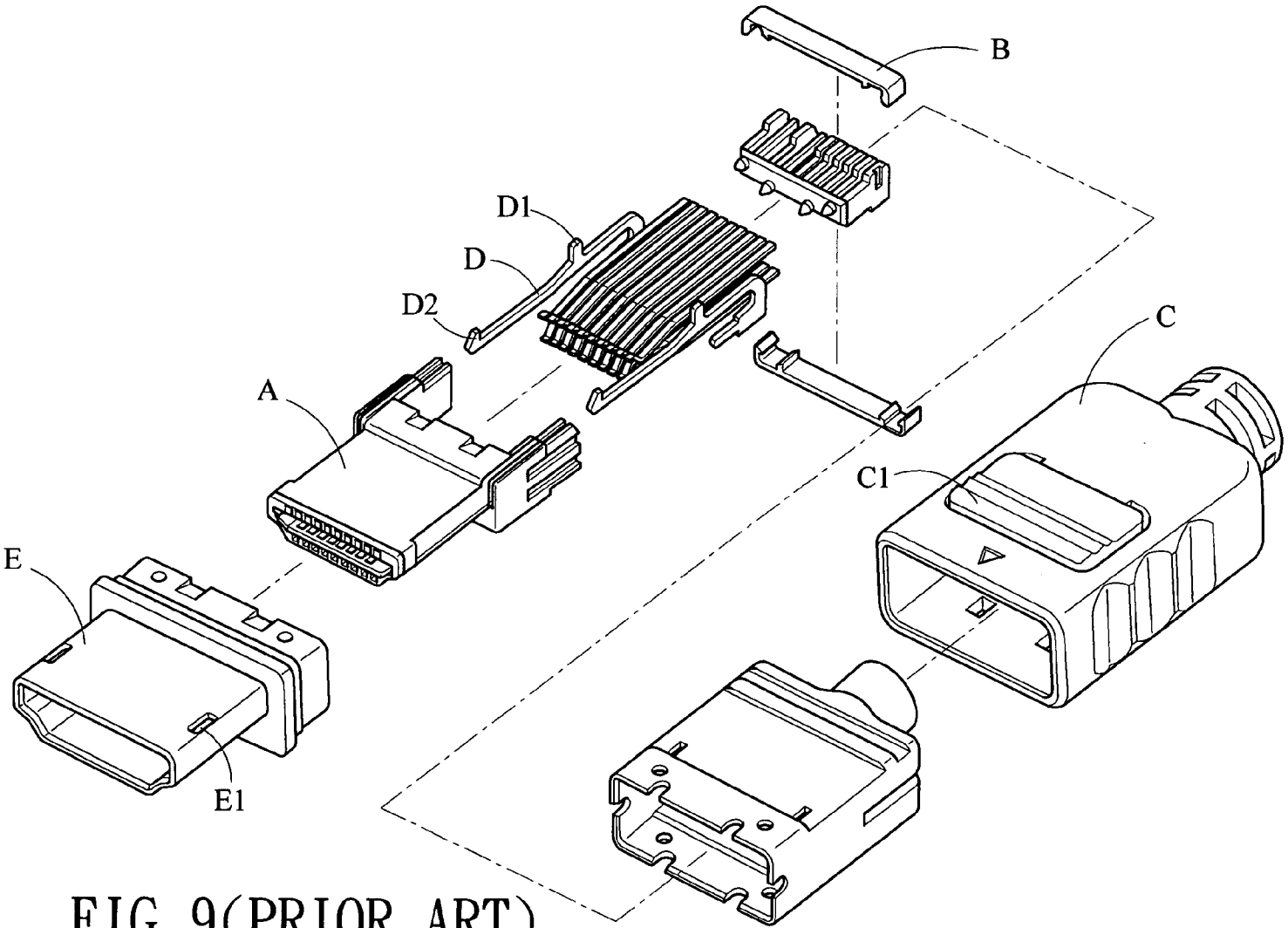
FIG. 9(PRIOR ART)
FIG. 9 is an exploded perspective view of a well known electrical connector according to U.S. Pat. No. 6,997,733.

Referring to FIGS. 7 and 8, an operation of disengaging the plug with the jack of the invention will be described in detailed below. In a normal state the slide member 11 is pushed forward to engage with a front end of the sixth opening 402 by the expansion of the spring 12. For disengaging the plug with the jack, a user may push the push button 111 rearward to compress the spring 12 and cause the inclined surfaces of the trigger 114 to push and press down the second protrusions 132 until the first protrusions 131 clear openings of the jack by retracting into the first openings 211. Thereafter, the user may disengage the plug with the jack since they are not fastened together.

The invention thus has the following advantages including a reliable fastening, a simple, effective unfastening step, and an elimination of any potential EMI (electromagnetic interference) by the provision of the grounding plate 28.

While the invention herein disclosed has been described by means of specific embodiments, numerous modifications and variations could be made thereto by those skilled in the art without departing from the scope and spirit of the invention set forth in the claims.

What is claimed is:

1. An electrical connector including a jack having two internal opening, and a plug comprising:

a top shell comprising a third opening;

a sliding unit comprising a rectangular slide member including a spring biased push top button slidably anchored in the third opening, and an indentation at either side, a front trigger adjacent a forward end of the indentation, and two elongated positioning devices each comprising a front first protrusion at one end, a rear U-shaped positioning member, and an intermediate second protrusion;

a shield case comprising a front sheath having two side first openings, an intermediate peripheral flange, two side first slits in a rear; an insulative body including a forward extension including two side flats, a front projected plate, and a plurality of lengthwise T-shaped first apertures arranged in upper and lower rows wherein the extension is fitted in the sheath; a rear U-shaped frame element including two inner recessed portions on both sides, and two rear sidewalls each including a lengthwise U-shaped second slit extended toward the flat wherein each positioning device is inserted through the second slit with the first protrusion passed the second slit and the flat to project from the first opening, and upper and lower grooves; a plurality of conductors tightly inserted into the first apertures; a grounding plate including two hooks extended forward from both sides; upper and lower transverse, flexible holding members each including two end latches and a plurality of second apertures wherein the upper and lower holding members are mounted on a portion between the second protrusions and rear ends of the positioning devices with the latches anchored in the grooves; and a rectangular base including a forward transverse cut with the grounding plate mounted therein, and a plurality of forward pegs fastened in the first apertures with the hooks securely received in the recessed portions and being in contact with the sheath;

a metal upper case comprising two lengthwise top second openings;

a metal lower case matingly secured to the upper case with the second protrusions projected from the second openings into the indentations;

a bottom shell; and a strain relief with an external portion of the conductors passed through and secured to the top and the bottom shells and; wherein:

the bottom shell is matingly secured to the top shell for forming the plug;

the push button is pushed forward to engage with a front end of the third opening in an inoperative state; and the push button is adapted to push rearward to cause the trigger to push and press down the second protrusions until the first protrusions clear the internal openings of the jack by retracting into the first openings such that a subsequent pulling of the plug will disengage the plug with the jack.

2. The electrical connector as claimed in claim 1, wherein the trigger comprises two inclined surfaces facing the indentations.

3. The electrical connector as claimed in claim 1, wherein the positioning member comprises teeth.

* * * * *

UNITED STATES PATENT AND TRADEMARK OFFICE

CERTIFICATE OF CORRECTION

PATENT NO. : 7,175,465 B1
APPLICATION NO. : 11/406326
DATED : February 13, 2007
INVENTOR(S) : Wen-Hsien Tsai It is certified that error appears in the above-identified patent and that said Letters Patent is hereby corrected as shown below:

On the title page, item (73) should read as follows:

--(73) Assignee: Advanced Connectek Inc., Taipei (TW)--

Signed and Sealed this

Eighteenth Day of September, 2007

JON W. DUDAS
*Director of the United States Patent and Trademark Office*